United States Patent [19]

Vettor et al.

[11] Patent Number: 4,946,474

[45] Date of Patent: Aug. 7, 1990

[54] PROCESS FOR BENEFICIATION OF COAL BY SELECTIVE CAKING

[75] Inventors: Antonio Vettor, San Donato Milanese; Nello Passarini, Colturano; Armando Marcotullio, San Donato Milanese, all of Italy

[73] Assignee: Eniricerche, S.p.A., Milan, Italy

[21] Appl. No.: 276,678

[22] Filed: Nov. 28, 1988

[30] Foreign Application Priority Data

Dec. 16, 1987 [IT] Italy ..... 23036 A/87

[51] Int. Cl.[5] ..... C10L 5/00

[52] U.S. Cl. ..... 44/627; 44/620

[58] Field of Search ..... 44/550, 620, 627

[56] References Cited

U.S. PATENT DOCUMENTS

| | | | |
|---|---|---|---|
| 4,332,593 | 6/1982 | Burgess et al. | 44/627 |
| 4,450,046 | 5/1984 | Rice et al. | 44/620 |
| 4,484,928 | 11/1984 | Keller, Jr. | 44/627 |
| 4,559,060 | 12/1985 | Muroi et al. | 44/627 |
| 4,770,766 | 9/1988 | Keller, Jr. et al. | 44/620 |

FOREIGN PATENT DOCUMENTS

| | | | |
|---|---|---|---|
| 234885 | 5/1925 | United Kingdom | 44/620 |
| 738061 | 10/1955 | United Kingdom | 44/620 |

*Primary Examiner*—Carl F. Dees

*Attorney, Agent, or Firm*—Hedman, Gibson, Costigan & Hoare

[57] ABSTRACT

A process is disclosed for beneficiation of coal by selective caking, in which process a caking mixture is employed consisting of:

one or more solvents selected among light hydrocarbons having boiling points not higher than 70° C.;

one or more non-ionic additives selected among oil soluble propoxylated or propoxylated-ethoxylated phenolic or alkylphenolic compounds;

possible one or more heavy co-caking agents selected among coal-derived oils having boiling points between 200° C. and 400° C., or the residual products of petroleum refining, or mixtures thereof.

20 Claims, No Drawings

PROCESS FOR BENEFICIATION OF COAL BY SELECTIVE CAKING

This invention relates to a process for beneficiation of coal through selective caking.

The best known processes for the beneficiation of coal are mainly founded on the difference between physical properties of the predominantly organic matter and the predominantly inorganic matter.

For example, such materials can be separated on the basis of their particle sizes or of their densities, or of their different electric or magnetic behaviour.

Said processes are not always conveniently applicable when the physical properties of the materials to separate are similar. A solution to that problem is given by the exploitation of another property of the phases to separate: their different affinities for water, which are typically exploited in caking and foam flotation processes.

In particular, the caking process consists in forming a water-coal dispersion to which an organic compound of hydrocarbon nature is added under stirring, in order to obtain the formation of caked masses mainly consisting of pure coal and a water dispersion containing solid matter which is predominantly inorganic in nature. Fuel oils of petroleum origin, heavy oils from distillation of coal pyrolysis tars, petroleum middle distillates (such as kerosene, gasoil, and so on) are employed as organic caking compounds.

A drawback of such procedure consists in the fact that oil employed for causing coal to cake is normally left behind in the product, with a consequent remarkable increase in the costs of processing.

On the other hand, the recovery of the caking agent possibly performed would cause an economic burden that would be onerous at the same or even at a higher extent because of the poor volatility of the products mentioned.

In order to obviate such drawbacks, use has been made of volatile hydrocarbon solvents and their derivatives as caking agents, which compounds can be recovered after the inorganic matter has been removed. The light hydrocarbon solvents employed are mainly n-pentane, n-hexane, petroleum ethers and their fluorochloroderivatives (Freons). Said solvents generally show selectivities higher than heavy solvents, but they show the drawback with respect to the latter of having lower bridging power, so that some coals having more unfavourable surface properties cake with heavier oils but they do not cake with light oils.

A caking process has been recently claimed in the Japanese Patent Application published before examination (kokay) JP No. 84/105089, said process employing together with a caking agent (selected among paraffin oil, light oil (petrol), crude oil, asphalt, oil from coal liquefaction, low-temperature tar, high-temperature tar, all kinds of residual oil and fuel oil (the preferred solvent)) also a non-ionic, oil soluble compound as an additive, and in particular ethoxylated nonylphenol in maximum amounts of 5% by weight with respect to the caking agent.

According to the Authors of said Patent Application, the process they claim is characterized by higher caking speeds, as well as by lower amounts of the caking agent employed and higher dehydration (i.e., lower water concentrations in the caked product), said process also allowing less amounts of ashes to be obtained in the final product.

Accordingly, such process is an improvement with respect to the use of the products mentioned above alone, but it is unsuitable to a final economic recovery of the caking agent because of the poor volatility of the liquids claimed. Moreover, no mention is made concerning the possibility of processing in that way partially oxidized coals that are otherwise uncakable.

This last mentioned aspect has been tackled by other researchers (for instance D. V. Keller, U.S. Pat. No. 4,484,928) who claimed the employment, together with light or heavy caking agents, of various additives such as carboxyl acids (in particular oleic acid and its salts), amines, alcohols and their derivatives, and so on, in the caking operations performed on partially oxidized coals. In the same Patent mentioned above, Keller also reports the employment of an ethoxylated phenol (whose composition has not been declared) as a way for remarkably shortening the caking times of a coal which is already cakable in itself. However, both the employment of acid or basic products and the employment of ethoxylated phenols do not allow many particularly difficult coals to become caked or agglomerated, because of the low bridging powers of the caking liquids employed (Freons, n-pentane, n-hexane, petroleum ethers), as shown in the following examples.

In the present instance, it was surprisingly found that, employing a particular caking mixture, it is possible to cause uncakable or precariously cakable coals to cake, even through processing with light solvents.

Very good results are simultaneously obtained both as regards selectivity and recovery.

Indeed, coal types such as a high-volatile bituminous Russian coal and the more a high-volatile bituminous coal from Columbia and a subbituminous Italian coal (from Sulcis), which coals do not cake with pentane alone or added with ethoxylated phenol because of their poor surface hydrophobic properties, can become caked through the employment of the mixture of the present invention. Obviously, it is also possible to obtain with such caking mixture advantages both as regards the reduction of caking time and the amount of the caking agent required, selectivity, yield and water concentration in the caked product, even in the case of coals which are already cakable.

In addition, such way appears to be economically advantageous due to the low concentration of the products employed in the caking solvent (said products being not intended for recovery).

The process for beneficiation of coal which is the object of the present invention through selective caking, is characterized in that it employs a caking mixture which is made up of:

one or more solvents selected among the light hydrocarbons having boiling points not higher than 70° C.;

one or more non-ionic additives selected among oil soluble propoxylated phenolic or alkylphenolic compounds;

possible one or more heavy co-caking agents selected among coal-derived oils having boiling points between 200° and 400° C. or the residual products of petroleum refining or mixtures of the same.

The solvent or the solvents is/are preferably contained in amounts between 2% and 50% by weight with respect to coal, more preferably between 3% and 20% by weight. Preferred light hydrocarbons are n-pentane, n-hexane and petroleum ethers.

The additive or the additives is/are preferably contained in amounts between 0.02 and 1% by weight with respect to coal, and more preferably between 0.05 and 0.3% by weight.

The oil soluble propoxylated phenolic or alkylphenolic compounds can also be eventually ethoxylated.

Said compounds can be obtained from phenol, from cresol and from xylenol (in their various configurations) or from higher phenols, through processing with propylene oxide alone or, in a block reaction, from propylene oxide followed by ethylene oxide.

Such compounds can be represented by the general formula as follows:

$$R-O[CH-\underset{\underset{CH_3}{|}}{CH}-O]_x-[CH_2-CH_2O]_y-H$$

wherein R-OH, that performs the function of a substrate in the propoxylation and possibly in the ethoxylation, is selected among:

phenol as such or as a mono- or di-substituted derivative, the substituent groups being $R^I$ and $R^{II}$ alpha- or beta-naphthol as such or as mono- or di-substituted naphthols, the substituent groups being $R^I$ and $R^{II}$ 4- or 5-indole, as such or as mono- or di-substituted indoles, the substituent groups being $R^I$ and $R^{II}$, wherein $R^I$ and $R^{II}$, which are the same or different from one another, can correspond to a hydrogen radical, or to the methyl or the ethyl or the propyl groups, x is between 2 and 100, preferably between 4 and 50, y is between 0 and 20, preferably between 0 and 10, the ratio x/y being greater than or equal to 2.3, and preferably being greater than or equal to 4, when y is greater than zero.

The preferred substrate for the propoxylation and the possible ethoxylation is phenol as such or as the mono- or di-substituted phenols, the substituting groups being $R^I$ and $R^{II}$.

In addition to the additive or to the additives selected among the oil soluble, propoxylated (and possibly also ethoxylated) phenolic or alkylphenolic compounds, the caking mixture can also possibly be made up of other non-ionic additives selected among the ethoxylated alkyl phenols.

The oil soluble ethoxylated compounds can be selected among the ethoxylated alkylphenols, having an alkyl group preferably with 8–12 and more preferably with 8–10 carbon atoms, and preferably with 3–8 and more preferably with 3–5 ethoxy groups, among which the octylphenol and the nonylphenol, ethoxylated with 3 or 4 ethoxy groups, are herein mainly mentioned.

Also in case the additives employed are selected among ethoxylated alkylphenols, it is preferable that the total amount of all additives is not higher than 1% with respect to coal.

The heavy co-caking agent or agents which are eventually present are preferably contained in amounts between 0 and 3% by weight with respect to coal, and more preferably between 0.2 and 2% by weight. Such products, employed in so reduced amounts, can be conveniently left behind in the beneficiated coal without heavy economic burdens.

Coal-derived oils can be obtained through pyrolysis or through coking or through hydroliquefaction of coal itself. In particular, they can be obtained from coke-oven tar, and more particularly from distillation of coke-oven tar.

Normally, oils derived from distillation of coke-oven coal tars can be obtained from various successive fractionations through distillation.

For instance, two products that can be employed as co-caking agents are obtained already from the first distillation process, i.e., a crude anthracene oil from the first distillation (with boiling point between 230° and 400° C.), and an anthracene oil from the second distillation (boiling point: 270°–400° C.), and a lighter product that cannot be employed as such. However, after dephenolizing and further redistillation, other cuts are obtained from said lighter product, the heaviest cuts (the gas washing oil or "debenzolizing oil", with boiling point 235°–300° C. and "pasty" anthracene oil (300°–400° C.)) being usable as co-caking agents.

Such oils deriving from distillation of coke-oven coal tar, can be employed alone or as mixtures of the same. A particular mixture of such oils is for instance creosote oil which is made up of mixtures of anthracene oils.

Products which are not liquid at room temperature ("pasty" products) can be employed as such or in the fluidized state through previous controlled crystallization and filtration of the starting "pasty" product.

A typical composition of a pasty anthracene oil is reported in the following Table 1.

TABLE 1

Main properties and typical composition of the pasty anthracene oil

| | |
|---|---|
| Fluidization temperature: | 70–80° C. |
| Distillation range: | 300–400° C. |
| Density: | 1.13–1.14 |
| Approximate composition: | |
| 5% acenaphthene and fluorene | |
| 30% phenanthrene | |
| 10% anthracene | |
| 10% carbazole | |
| 5% pyrenes | |
| 2% products containing heteroatoms (N and O) | |

the balance to 100 is given by higher homologues of the products listed above.

The "fluidized" variant contains about less 40% of anthracene and carbazole, whereas the higher homologues keep in the filtered product because they are liquid for the most part.

The residual products of petroleum refining can be those coming from the bottoms of atmospheric distillation processes, of vacuum distillation or of cracking processes. Said residual products or bottoms can be employed as such or they can be previously "flushed" with middle distillates (gasoil, kerosene and so on).

The "flushed" bottoms are called more usually fuel oils.

The stages which the process of the present invention is made up of are those already known, i.e., the following:

milling coal to particle sizes not larger than 4 mm, preferably not larger than 1 mm;

dispersing the milled coal into water at a concentration between 5% and 30% by weight with respect to the dispersion itself;

adding the caking mixture, as such or as a water emulsion previously prepared to the dispersion so formed;

stirring the dispersion at high speed for times ranging preferably between 1 and 20 minutes;

possibly stabilizing and growing the coalescence products through gentle stirring for times ranging preferably between 1 and 10 minutes;

separating the caked mass from the inorganic matter dispersed in the water phase by screening and possibly by washing said agglomerated mass, or by skimming or by decantation.

In order to better illustrate the meaning of the present invention, some examples are reported in the following, which are not to be considered as limitative of the invention itself.

The following table illustrates some properties of coals processed in the examples mentioned above; in particular, for better differentiating the three types of high-volatile bituminous coals, the comparative results are herein reported as obtained from the analysis of the surface composition through XPS (X-ray photo Spectrometry).

It is evident that the coals from Russia and from Columbia show the lowest tendency to caking or agglomeration (as confirmed in the following examples), whereas for the Italian coal (from Sulcis) such aspect is already put into evidence by its type.

TABLE

| Percentage distribution of surface oxy-groups | | | | |
|---|---|---|---|---|
| Functional groups | | Russian coal | Columbian coal | Polish coal |
| C—C—C | | 69.7% | 70.9% | 82.5% |
| C—O—C | C—O—H | 17.4% | 17.5% | 9.2% |
| C=O | O—C—O | 7.3% | 7.0% | 4.2% |
| O—C=O | | 2.7% | 3.0% | 2.5% |
| 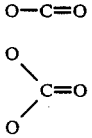 | | 2.7% | 1.7% | 1.7% |
| $C/C_{ox}$ ratio (the carbon/oxidized carbon ratio) | | 2.54 | 2.58 | 5.19 |
| total ashes, % by weight | | 14.0 | 10.5 | 10.8 |

EXAMPLE 1

A high-volatile bituminous coal from Russia, containing 14% by weight of ashes, is milled to a maximum granulometry of 750 μm.

50 g of such coal is dispersed in 200 ml of water and stirred in a suitable reactor provided with baffles and a blade double turbine stirrer, in order to allow a complete wetting to be obtained of the phase richest in inorganic matter.

The stirring time is of 5 minutes, at a speed of 1,000 rounds per minute (rpm).

After increasing the speed to 2,000 rpm, the caking mixture is added, said mixture consisting of 7 g of light solvent (n-hexane, 14% by weight on the coal basis (c.b.)), 0.05 g of mixed cresols (the ortho-meta-para cresols) propoxylated with 6 (average) oxypropylenic units (0.1% by weight c.b.) and 0.5 g of a fuel oil commercially available (1% by weight c.b.).

The stirring at high speed is kept for two minutes in order to allow the caking packet to develop an efficient action; then the mixture is stirred for additional 5 minutes at 1,000 rpm in order to obtain a further increase in the sizes of the caked products. Finally the caked or agglomerated product is recovered through screening with a screen having meshes of 750 μ.

The caked product is characterized in terms of weight and composition (percentage of ashes).

The results so obtained were as follows:

| | |
|---|---|
| Recovery of the heat value | 93.5% by weight |
| Ash percentage | 3.2% by weight |

EXAMPLE 2

With respect to example 1, a caking mixture is employed consisting of n-hexane (7 g; 14% by weight c.b.), a pasty anthracene oil from the processing of coke-oven tars (0.5 g; 1% by weight c.b.) and a propoxylated phenol with 12 (average) propoxylene units (0.05 g; 0.1% by weight c.b.).

The time required for the stirring stage at high speed is again of 2 minutes.

Results were as follows:

| | |
|---|---|
| recovery of the heat value | 94% by weight |
| ash percentage | 3.0% by weight |

EXAMPLE 3

With respect to example 1, a caking mixture is employed consisting of n-hexane (7 g; 14% by weight c.b.), a pasty anthracene oil (0.5 g; 1% by weight c.b.) and mixed cresols (ortho-meta-para cresols) propoxylated with 6 (average) propoxylene units (0.05 g; 0.1% by weight c.b.).

The time necessary for the stirring stage at high speed is again of 2 minutes.

Results were as follows:

| | |
|---|---|
| recovery of the heat value | 94% by weight |
| ash percentage | 3.0% by weight |

EXAMPLE 4 (comparative)

With respect to example 1, caking mixtures are employed containing just n-hexane in amounts respectively of 2.5 g (5% by weight c.b.), 5 g (10% by weight c.b.), 7.5 g (15% by weight c.b.), 10 g (20% by weight c.b.) and 15 g (30% by weight c.b.).

For all said amounts, no consistent result is obtained even by prolonging the stirring stage at high speed till 30 minutes, and the recovery of the heat value keeps lower than 20% by weight in all cases.

EXAMPLE 5 (comparative)

With respect to example 1, caking mixtures are employed consisting of n-hexane and propoxylated phenol containing 6 (average) oxypropylene groups in amounts respectively of 5 g (10% by weight c.b.) and 0.025 g (0.05% by weight c.b.), 20 g (40% by weight c.b.) and 0.1 g (0.2% by weight c.b.).

For all said amounts, no consistent result is obtained even by prolonging the stirring stage at high speed up to 30 minutes, and the recovery of the heat value is lower than 20% by weight in all cases.

EXAMPLES 6–8 (comparative)

With respect to example 1, 3 different caking mixtures are employed consisting of:

n-hexane (7 g; 14% by weight c.b.) and fuel oil (0.5 g; 1% by weight c.b.) (example 6);
n-hexane (6 g; 12% by weight c.b.) and fuel oil (1.5 g; 3% by weight c.b.) (example 7)
n-hexane (6 g; 12% by weight c.b.) and anthracene oil (1.5 g; 3% by weight c.b.) (example 8).

Results were as follows:

| Example | Recovery, % | Ashes percentage | Stirring time at high speed |
|---|---|---|---|
| 6 | 88.3% wt. | 3.1% wt. | 15 min |
| 7 | 93.5% wt. | 3.8% wt. | 10 min |
| 8 | 94.0% wt. | 3.2% wt. | 10 min |

EXAMPLE 9

A high-volatile bituminous coal from Columbia, containing 10.5% wt. ashes, is processed as disclosed in example 1, employing the same caking mixture as that used in said example.

The time required for the stirring stage at high speed is of 10 minutes.

Results were as follows:

| | |
|---|---|
| recovery of the heat value | 95.2% by weight |
| ash percentage | 2.2% by weight. |

EXAMPLE 10

With respect to example 9, a caking mixture is employed consisting of n-hexane (6 g; 12% by weight c.b.), fuel oil (1.5 g; 3% wt. c.b.) and propoxylated phenol having 6 (average) propoxyl units (0.1 g; 0.2% by wt. c.b.).

The time necessary for the stirring stage at high speed is of 5 minutes.

Results were as follows:

| | |
|---|---|
| recovery of the heat value | 94.1% by weight |
| ash percentage | 2.7% by weight |

EXAMPLE 11

With respect to example 9, a caking mixture is employed consisting of n-hexane (7 g; 14% by weight c.b.), fuel oil (0.5 g; 1% wt. c.b.) and propoxylated phenol having 12 (average) propoxylene units (0.05 g; 0.1% wt. c.b.). The time necessary for the stirring stage at high speed is of 10 minutes.

Results were as follows:

| | |
|---|---|
| recovery of the heat value | 92.8% by weight |
| ash percentage | 2.0% by weight |

EXAMPLE 12

With respect to example 9, a caking mixture was employed consisting of n-hexane (7 g, 14% wt. c.b.), an anthracene oil (0.5 g, 1% wt. c.b.) and propoxylated cresols (ortho-meta-para cresols) having 6 (average) propoxylene units (0.05 g, 0.1% wt. c.b.).

The time necessary for the stirring stage at high speed is of 10 minutes.

Results were as follows:

| | |
|---|---|
| recovery of the heat value | 93.1% |
| ash percentage | 2.0% |

EXAMPLE 13

With respect to example 9, a caking mixture was employed consisting of n-hexane (7 g, 14% wt. c.b.), fuel oil (0.5 g, 1% wt. c.b.) and propoxylated cresols (ortho-meta-para cresols) having 10 (average) propoxylene units, and next (block) ethoxylated with two oxyethylene units (0.05 g, 0.1% wt. c.b.).

The time necessary for the stirring stage at high speed is of 10 minutes.

| | |
|---|---|
| Recovery of the heat value | 93.8% wt. |
| ash percentage | 2.3% wt. |

EXAMPLE 14 (comparative)

With respect to example 9, caking mixtures are employed containing just n-hexane in amounts respectively of 2.5 g (5% wt. c.b.), 5 g (10% wt. c.b.), 7.5 g (15% wt. c.b.), 10 g (20% wt. c.b.) and 15 g (30% wt. c.b.).

For all said amounts, no consistent result was obtained even by prolonging the stirring stage at high speed up to 30 minutes, and in all cases the recovery of the heat value was lower than 20% wt.

EXAMPLES 15–17 (comparative)

With respect to example 9, 3 different caking mixtures are employed consisting of:
n-hexane (7 g, 14% wt. c.b.) and fuel oil (0.5 g, 1% wt. c.b.) (example 15);
n-hexane (6.5 g, 13% wt. c.b.) and fuel oil (1 g, 2% wt. c.b.) (example 16);
n-hexane (6 g, 12% wt. c.b.) and anthracene oil (1.5 g, 3% wt. c.b.) (example 17).

Results are as follows:

| Example | Recovery, % | Ash percentage | Stirring time at high speed |
|---|---|---|---|
| 15 | 68% wt. | 2.0% wt. | 30 min |
| 16 | 75% wt. | 1.9% wt. | 30 min |
| 17 | 73% wt. | 2.2% wt. | 30 min |

EXAMPLE 18

A sub-bituminous Italian coal (from Sulcis), already conditioned by atmospheric agents for a long time and containing 22% ashes is processed as disclosed in example 1, but employing a caking mixture consisting of n-hexane (6 g, 12% wt. c.b.), fuel oil (1.0 g, 2% wt. c.b.), cresols (ortho-meta-para cresols) propoxylated with an average number of 6 propoxylene units (0.1 g, 0.2% wt. c.b.).

The time necessary for the stirring stage at high speed is of 8 minutes.

Results are as follows:

| | |
|---|---|
| recovery of the heat value | 82% wt. |
| ash percentage | 10% wt. |

EXAMPLE 19 (comparative)

With respect to example 18, caking mixtures are employed containing just n-hexane in amounts respectively of 2.5 g (5% wt. c.b.), 5 g (10% wt. c.b.), 7.5 g (15% wt. c.b.), 10 g (20% wt. c.b.) and 15 g (30% wt. c.b.).

For all said amounts, no consistent result is obtained even by prolonging the time of the stirring stage at high speed up to 30 minutes, and the recovery of the heat value is lower than 20% by weight in all cases.

EXAMPLE 20

A high-volatile bituminous coal from Poland, containing 10.8% ashes is processed as disclosed in example 1 with the same caking mixture as that employed in said example.

The time necessary for the stirring stage at high speed is of 30 seconds.

Results are as follows:

| | |
|---|---|
| recovery of the heat value | 95.5% wt. |
| ash percentage | 4.0% wt. |

EXAMPLE 21

With respect to example 20, a caking mixture is employed consisting of n-hexane (7 g, 14% wt. c.b.) anthracene oil (0.5 g 1% wt. c.b.) and phenol propoxylated with an average number of 12 propoxylene units (0.05 g, 0.1% wt. c.b.).

The time necessary for the stirring stage at high speed is of 30 seconds.

Results are as follows:

| | |
|---|---|
| recovery of the heat value | 95.0% wt. |
| ash percentage | 4.2% wt. |

EXAMPLE 22

With respect to example 20, a caking mixture is employed consisting of n-hexane (7 g, 14% wt. c.b.) and propoxylated phenol having 6 (average) propoxylene units (0.025 g, 0.05% wt. c.b.). The time necessary for the stirring stage at high speed is of 30 seconds.

Results are as follows:

| | |
|---|---|
| recovery of the heat value | 94.4% wt. |
| ash percentage | 4.0% wt. |

EXAMPLE 23 (comparative)

With respect to example 20, a caking mixture is employed containing just n-hexane (5 g, 10% wt. c.b.).

The time necessary for the stirring stage at high temperature is of 3 minutes.

Results are as follows:

| | |
|---|---|
| recovery of the heat value | 93% wt. |
| ash percentage | 4.0% wt. |

We claim:

1. A process for benefication of coal with a caking composition, said caking composition comprising of at least one solvent selected from light hydrocarbons having a boiling point not higher than 70° C.; and at least one non-ionic additive selected from propoxylated phenolic and propoxylated alkylphenolic compounds which are oil soluble.

2. The process of claim 1 wherein the caking composition furthermore comprises at least one co-caking agent selected from among the group consisting of a coal-derived oil having a boiling point between 200° C. and 400° C., and a residual product of petroleum refining, and mixtures thereof.

3. The process of claim 2 wherein said solvent is present in an amount from 2% to 50% by weight with respect to coal, said non-ionic additive is present in an amount from 0.02% to 1.0% by weight with respect to coal, and the co-caking agent is present in an amount up to about 3% by weight with respect to coal.

4. The process of claim 3 wherein said said solvent is present in an amount from 3% to 20% by weight with respect to coal, said non-ionic additive is present in an amount from 0.05% to 0.3% by weight with respect to coal and the co-caking agent is present in an amount from 0.2% to 2.0% by weight with respect to coal.

5. The process of claims 1 or 2 wherein said solvent is selected from the group consisting of n-pentane, n-hexane and at least one petroleum ether.

6. The process of claims 1 or 2, wherein said non-ionic additive is ethoxylated.

7. The process of claim 6, wherein said non-ionic additive has the general formula:

$$R-O[\underset{CH3}{CH}-CH-O]_x-[CH_2-CH_2O]_y-H$$

Wherein phenol unsubstituted or mono or disubstituted an alpha or beta naphtol, unsubstituted or mono or disubstituted; 4-or-5 indole, unsubstituted or mono disubstituted. Where X is between 2 and 100, Y is between 0 and 20, said X/Y ratio is equal to or greater than 2.3.

8. The process according to claim 7, wherein X is between 4 and 50, Y is between 0 and 10 and said X/Y ratio is equal to or greater than 4.

9. The process according to claim 1 or 2, wherein said non-ionic additive is obtained from Phenol; Cresol; or Xylenol.

10. The process according to claim 1 or 2, wherein said non-ionic additive is ethoxylated alkyphenol.

11. The process according to claim 10, wherein said ethoxylated alklphenol comprises of at least one alkyl group having from 8 to 12 carbon atoms and further comprising from 3 to 8 ethoxyl groups.

12. The process according to claim 11, wherein said ethoxylated alkyphenol comprises of at least one alkyl group having from 8 to 10 carbon atoms and further comprising from 3 to 5 ethoxyl groups.

13. The process according to claim 12, wherein said ethoxylated alkylphenol comprises enthoxylated octylphenol and othoxylated nonylphenol having from 3 to 4 ethoxyl groups.

14. The process according to claim 1 or 2, wherein said co-caking agent is selected from among anthracene oil, gas washing oil or a mixture thereof.

15. The process according to claim 14, wherein said anthracene oil mixture is a creosote oil.

16. The process according to claim 1 or 2, wherein said residual product of petroleum refining is derived from the bottoms of distillation, vacuum distillation; cracking processes.

17. The process according to claim 16, wherein said residual product of petroleum refining is fuel oil.

18. The process according to claim 1 or 2, wherein said coal-derived oil is obtained from Pyrolysis; Caking; or Hydroliquefaction of coal.

19. The process according to claim 18, wherein said coal-derived oil is derived from coke-oven tars.

20. The process according to claim 19, wherein said coke-oventars are distillated.

* * * * *